US009828221B2

(12) United States Patent
Mohr

(10) Patent No.: US 9,828,221 B2
(45) Date of Patent: Nov. 28, 2017

(54) SCISSORS LIFT PLATFORM

(71) Applicant: Christoph Mohr, Bielefeld (DE)

(72) Inventor: Christoph Mohr, Bielefeld (DE)

( * ) Notice: Subject to any disclaimer, the term of this patent is extended or adjusted under 35 U.S.C. 154(b) by 184 days.

(21) Appl. No.: 14/424,179

(22) PCT Filed: Aug. 14, 2013

(86) PCT No.: PCT/EP2013/002461

§ 371 (c)(1),
(2) Date: Feb. 26, 2015

(87) PCT Pub. No.: WO2014/032776

PCT Pub. Date: Mar. 6, 2014

(65) Prior Publication Data

US 2015/0298949 A1 Oct. 22, 2015

(30) Foreign Application Priority Data

Sep. 1, 2012 (DE) ..... 20 2012 008 386 U

(51) Int. Cl.
*B66F 7/06* (2006.01)
*B66F 7/08* (2006.01)
*B66F 7/28* (2006.01)

(52) U.S. Cl.
CPC ..... *B66F 7/065* (2013.01); *B66F 7/0666* (2013.01); *B66F 7/08* (2013.01); *B66F 7/28* (2013.01)

(58) Field of Classification Search
CPC ..... B66F 7/065; B66F 7/28; B66F 7/0666; B66F 7/08; Y10T 16/537; Y10T 16/48; Y10T 16/551
USPC ..... 254/122, 249, 126; 187/269, 211; 16/221, 273, 357, 362, 378, 386; 188/269
See application file for complete search history.

(56) References Cited

U.S. PATENT DOCUMENTS 748,387 A * 12/1903 Lilly ..... B65F 1/1415 248/436
1,011,585 A * 12/1911 Creasey ..... A47B 87/002 108/116
1,488,811 A * 4/1924 Patterson ..... F16G 11/12 254/249
1,941,301 A * 12/1933 Hanson ..... F24C 15/16 126/25 A (Continued)

FOREIGN PATENT DOCUMENTS

DE 7523972 8/1977
DE 3527324 2/1987

(Continued)

OTHER PUBLICATIONS

International Search Report in German Application 20 2012 008 386.4, German Patent Office, dated Jun. 20, 2013.

(Continued)

*Primary Examiner* — Larry E Waggle, Jr.
*Assistant Examiner* — Mahdi H Nejad

(57) ABSTRACT

A scissor-lift platform comprises a scissor mechanism (1) and scissor elements (3) that are connected to form scissor element pairs by central bearings (2). At least one scissor element (3) of a scissor element pair has a bearing receiving element (4) that is removably connected to the scissor element (3) in order to receive the central bearing (2).

11 Claims, 4 Drawing Sheets

(56) References Cited

U.S. PATENT DOCUMENTS 2,755,595 A * 7/1956 Meyer ..... B68G 15/00 254/248
2,862,689 A * 12/1958 Dalrymple ..... B66F 7/065 187/269
2,931,519 A * 4/1960 Beach ..... B66F 7/0625 254/134
3,781,159 A * 12/1973 Lidl ..... B29C 45/68 100/264
4,638,886 A * 1/1987 Marietta ..... B66F 7/04 187/207
4,890,950 A * 1/1990 Yoo ..... E06C 1/32 16/328
4,995,130 A * 2/1991 Hahn ..... B65G 69/2823 14/71.3
5,429,210 A * 7/1995 Hansen ..... B66B 9/16 187/243
5,857,649 A * 1/1999 Eason ..... F16M 11/38 248/164
5,934,414 A 8/1999 Staczek
6,286,629 B1 * 9/2001 Saunders ..... B66B 9/0853 187/394
6,860,454 B1 * 3/2005 Gronowicz, Jr. ..... H02G 3/30 248/67.7
6,986,188 B2 * 1/2006 Lu ..... G06F 1/1616 16/263
8,191,865 B2 * 6/2012 Polins ..... B66B 9/16 254/122
2007/0131091 A1 * 6/2007 Hsieh ..... F16M 11/38 84/423 R
2008/0105498 A1 * 5/2008 Perkins ..... B66F 11/042 187/269
2008/0224107 A1 * 9/2008 Polins ..... B66B 9/16 254/45
2011/0271488 A1 * 11/2011 Swinderman ..... B25G 1/04 16/421
2015/0121987 A1 * 5/2015 Flynn ..... B21D 37/14 72/481.8
2015/0321891 A1 * 11/2015 Mohr ..... B66F 7/28 254/122

FOREIGN PATENT DOCUMENTS

DE 20 200 6012077 10/2007
DE 20 200 6012777 12/2007
DE 20200612777 U1 * 1/2008
DE 202006012777 * 1/2008
EP 0439291 7/1991
FR 2961799 A1 * 6/2010
FR 2961799 12/2011
JP 2004262569 A * 2/2003
JP 200 4262569 9/2004

OTHER PUBLICATIONS

International Search Report for PCT Application, PCT/EP2013/002461, EPO, dated Oct. 18, 2013.

* cited by examiner

SCISSORS LIFT PLATFORM

TECHNICAL FIELD

The invention relates to a scissor-lift platform and more particularly, to a scissor lift platform wherein a scissor mechanism and scissor elements are connected to form scissor element pairs by central bearings. At least one scissor element of a scissor element pair has a bearing receiving element that is removably connected to the scissor element in order to receive the central bearing.

BACKGROUND INFORMATION

Scissor-lift platforms are already known. As a rule, the scissor mechanisms of such scissor-lift platforms are formed of two scissor blade pairs, which are spaced apart and connected to each other through suitable cross-bracings. The individual scissor blade pairs each have two scissor blades that are connected to each other through a central bearing and can rotate against each other. The central bearing is located at approximately half of the length of the scissor blades.

According to the prior art, pivoting bearings and self-lubricating slide bearings in particular, and so-called DU bushings in particular, have proven themselves for the central bearing.

According to the prior art, bore holes are introduced into the scissor blades and are designed such that they form a suitable bearing seat for the bearing to be used.

Not only with respect to its size but also with respect to its implementation, e.g., the surface condition, must the bore holes be designed such that they are suitable as a bearing seat for the bearing to be used. Since such scissor-lift platforms are typically one-offs, specified to a customer's desire, this means high production costs. Furthermore, subsequent replacement of the bearings, for example for repair or maintenance work, is difficult, if, for example, outer rings of the bearing are pressed into the bearing seats. In case of damage to a bearing, the scissor mechanism is most often also damaged to such an extent that significant repair effort or even replacement of the entire inner scissor mechanism becomes necessary. A change to a different bearing type or a different bearing size cannot be realized in a simple manner as well.

SUMMARY OF THE INVENTION

The problem addressed by the invention is, therefore, to create a scissor-lift platform, where production, assembly and disassembly of the scissor blade pairs and their central bearing is possible in a simple and cost-effective manner.

According to the invention, the problem is solved in that at least one scissor blade of a scissor blade pair has a bearing receiving element detachably connected to the scissor blade for receiving a central bearing.

The bearing receiving element, which is preferably housed in a fitting opening—designed, for example, as a bore hole, —of the scissor blade, can be assembled and disassembled easily due to its detachable connection with the scissor blade. The advantage of such bearing receiving elements that are detachably connected with the scissor blade is that no bearing seat needs to be produced in the scissor blade during the manufacture of the scissor blades but only a connectivity of the scissor blade with the bearing receiving element needs to be provided. If an opening that receives the bearing receiving element inside the scissor blade is to be produced for this purpose, then the bearing can be provided inside the scissor blade, i.e., in the same position where it would also be located at a conventional scissor blade, i.e., no additional installation space is required in the width of the scissor blade pair.

According to the invention, the bearing receiving element has two essential features. For one, it is designed such that it can be connected detachably with the scissor blade, for which it preferably has a connection region, for example a flange. Furthermore, its outer contour must be designed such that it can be connected with the scissor blade.

The bearing receiving element is designed such that it is suitable for receiving the intended bearing, i.e., it has a receiving region, for example a bore hole for a bearing to be used, where said receiving region is designed such that it constitutes a suitable bearing seat for the used bearing type.

In the case of a pivoting bearing, this can also be a receptacle for a bolt, which is preferably housed in a manner preventing rotation and is supported rotatably in the pivoting bearing of the other scissor blade of the scissor blade pair. The advantage realized by this is that while the large-scale scissor blades only need to be provided with an interface suitable for the bearing receiving elements, which are preferably designed the same for all types of bearing receiving elements, the bearing seats, which are potentially subject to high tolerance requirements, are produced in relatively small, easily handled parts. Because the bearings are only inserted into the bearing receiving elements, for example pressed together, the bearing receiving element can now advantageously be replaced together with the bearing, which as a rule can take place in a simple manner directly on site and in the most favorable case even without removing the scissor blades from the scissor-lift platform due to the detachable connection.

Thus, according to the invention a modular system can be provided for the installation or replacement of central bearings in the scissor-lift platform. The concept of the modular system is based on the fact that the scissor blades have means of connection, in particular openings in their regions that are to be connected to each other through central bearings. Additionally, a plurality of various types of bearing receiving elements is available and can be connected selectively with the scissor blades. The various types of bearing receiving elements have differing inner contours each fitting for the respective central bearing that is to be housed in the bearing. This modular system according to the invention allows for combining different central bearing and scissor blade combinations in a simple manner.

Central bearings can also be exchanged with each other in a simple manner, for example if the design of the central bearing proves to be erroneous later on, if a bearing is worn and a bearing of the same design is no longer available. In any case, the replacement of a bearing with an identical bearing on site is also significantly simplified compared to conventional bearings.

BRIEF DESCRIPTION OF THE FIGURES OF THE DRAWING

These and other features and advantages of the present invention will be better understood by reading the following detailed description, taken together with the drawings wherein.

PREFERRED EMBODIMENT

Figure 1:
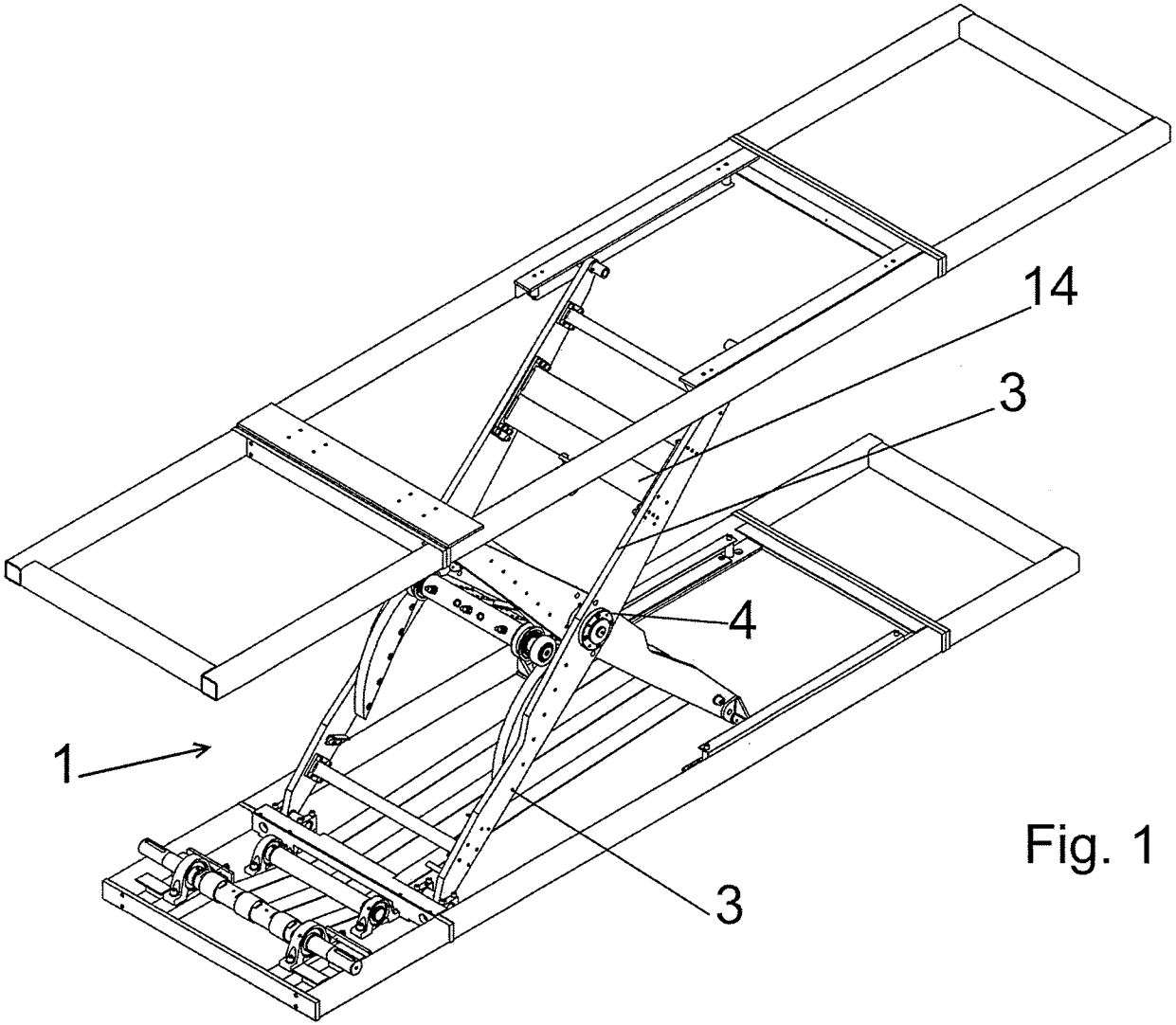
FIG. 1 is a schematic presentation of an exemplary scissor-lift platform according to the invention.
Figure 2:
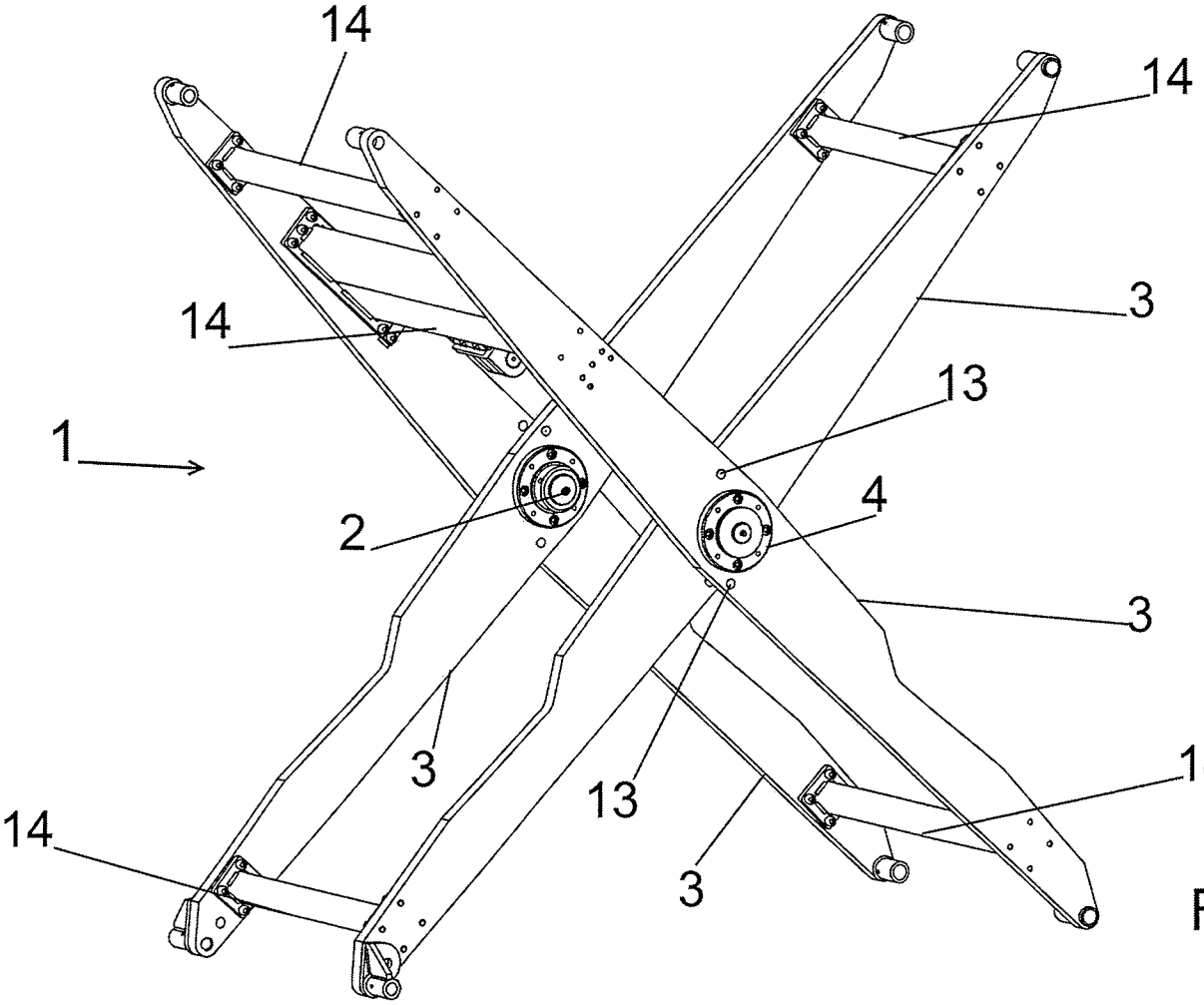
FIG. 2 is a schematic exemplary presentation of a scissor-mechanism of an exemplary lift platform according to the invention.

In the exemplary scissor-lift platform according to the invention, two scissor blades 3, FIGS. 1 and 2, each are connected into scissor blade pairs using a central bearing 2, which is housed in a bearing receiving element 4. The two scissor blade pairs are connected by cross bracing elements 14 to form a scissor blade mechanism 1.

The scissor blades 3 have means of connection in the form of openings 5 that are compatible with the bearing receiving elements 4, with the bearing receiving elements 4 being inserted in said opening 5. A connection region 6 of the bearing receiving elements 4, designed in the shown example as a flange, serves for detachable, rotation-preventive fastening of the bearing receiving elements 4 in the bearing blades 3.

In order to further simplify the replacement of the bearing receiving elements, the exemplary scissor-lift platforms may also have load-relieving device 13 that serves the purpose of securing the scissor mechanism such that the central bearing becomes load-free and thus can be removed from the scissor-lift platform in the ideal case without additional measures for disassembly of the entire scissor blade mechanism 1.

In the simplest embodiment, these load-relieving devices 13 can be designed in the form of bore holes located in the scissor blades 3 and are designed such that they overlap in the position of the scissor-lift platform desired for disassembly that a securing element, for example a socket pin, can be inserted and assume the loads that are otherwise assumed by the central bearing.

Figure 3:
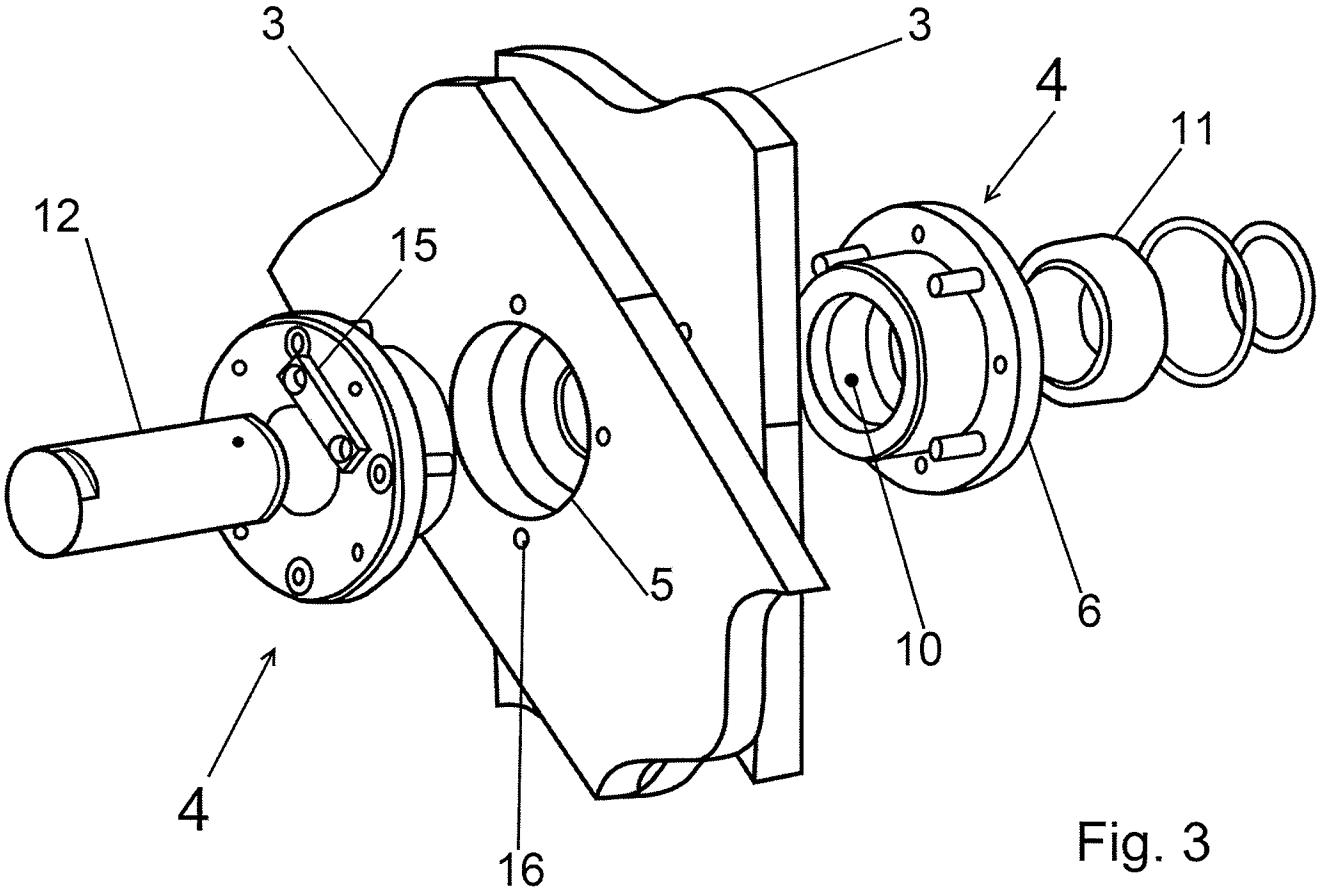
FIG. 3 is an exploded schematic view of the connection of two scissor blades through the central bearing for an exemplary scissor-lift platform according to the invention.

In the exemplary embodiment according to FIG. 3, a pivoting bearing 11 is used as the bearing. Accordingly, one of the bearing receiving elements 4 is provided with a bearing seat 10 for the outer ring of the pivoting bearing 11.

The bearing receiving element 4 in the other bearing blade 3 of the bearing blade pair has an opening for a bolt 12 with a protection against rotation 15. In the shown example, the bolt 12 is the shaft of the pivoting bearing 11 and accordingly is designed as a suitable bearing seat, in the shown example with a retainer ring.

Figure 4:
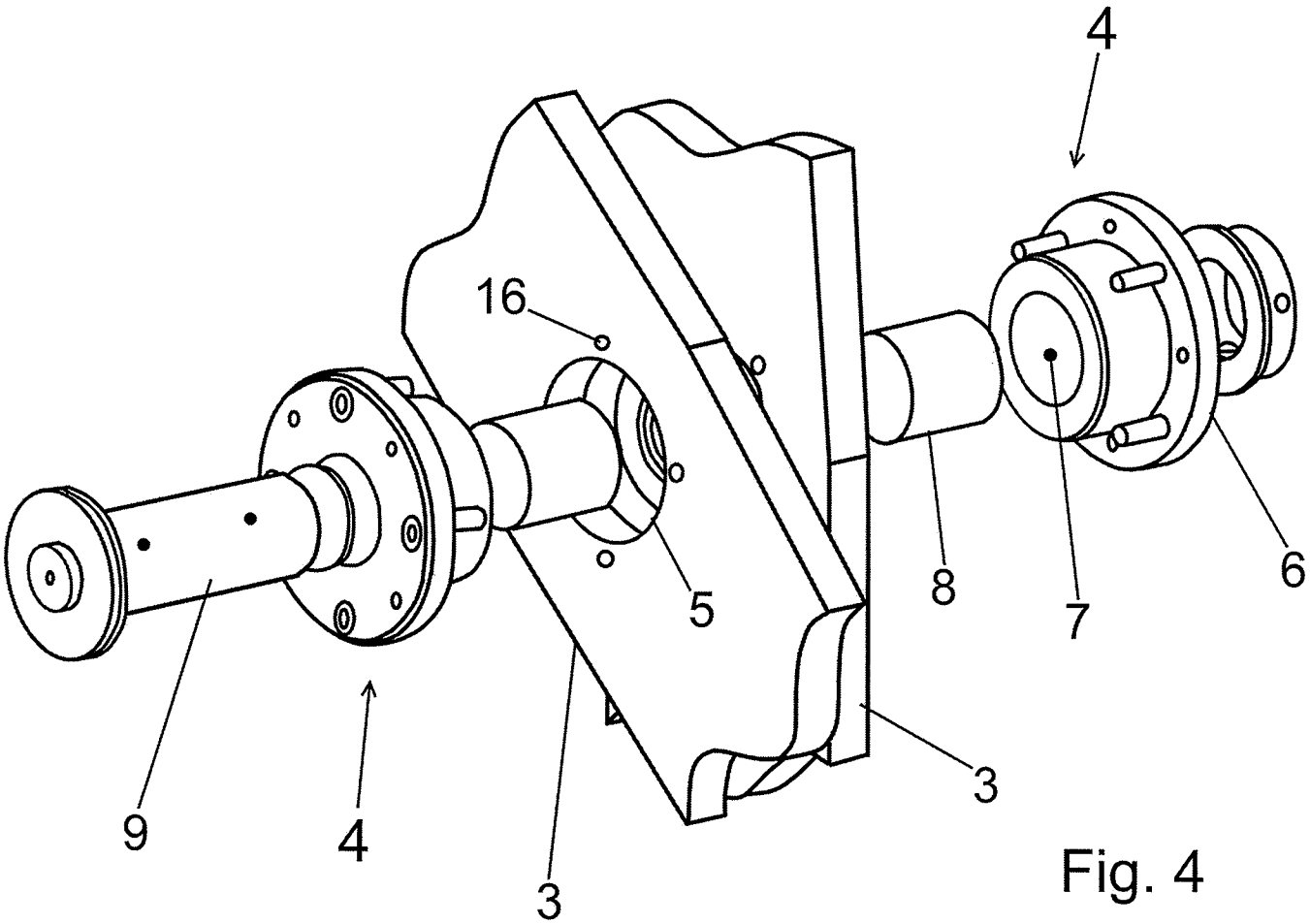
FIG. 4 is a similar exploded schematic view as in FIG. 3 using a different central bearing type.

FIG. 4 shows an additional exemplary embodiment, where both scissor blades 3 of the shown scissor blade pair are connected with bearing receiving elements 4. In the shown example, both bearing receiving elements 4 receive bearing bushings 8 with a joint shaft 9. Each of the two bearing bushings 8 forms a slide bearing together with the shaft 9. In an advantageous manner, this bearing can be designed as a self-lubricating bearing, for example a DU bearing.

In the shown examples, screws are used for the detachable connection of the bearing receiving elements 4 with the scissor blades 3 as detachable fastening elements, and are screwed through the connection regions of the bearing receiving elements 4 designed as flanges 6 into bore holes 16 of the scissor blades 3 provided for this purpose.

Accordingly, the present invention provided a novel and non-obvious scissor lift mechanism wherein a scissor-lift platform comprises a scissor mechanism and scissor elements that are connected to form scissor element pairs by central bearings. At least one scissor element of a scissor element pair has a bearing receiving element that is removably connected to the scissor element in order to receive the central bearing.

Modifications and substitutions by one of ordinary skill in the art are considered to be within the scope of the present invention, which is not to be limited except by the allowed claims and their legal equivalents.

The invention claimed is:

1. A scissor-lift mechanism (1) for a scissor-lift platform, said scissor-lift mechanism (1) comprising first and second scissor blades (3) connected through a central bearings (2) to form a first scissor blade pair, and first and second scissor blades (3) connected through a central bearing (2) to form a second scissor blade pair, characterized in that at least one scissor blade (3) of each of the first and second scissor blade pairs includes a bearing receiving element (4) configured for housing the central bearing (2), and wherein the bearing receiving element (4) is connected to the at least one scissor blade (3) of each of the first and second scissor blade pairs in a detachable manner, and wherein each of said first and second scissor blade pairs includes a load-relieving device (13) configured for relief of a load on said central scissor bearing (2) of said respective first and second scissor blade pairs when said scissor-lift platform is in an assembled condition, wherein said load-relieving device (13) comprises first and second bore holes in each of said first and second scissor blades of each of said first and second scissor blade pairs, wherein said first bore hole in the first scissor blade in both said first and second scissor blade pairs is configured for aligning with said first bore hole in said second scissor blade of each of said first and second scissor blade pairs, and wherein said second bore hole from said first scissor blade in both said first and second scissor blade pairs is configured for aligning with said second bore hole in said second scissor blade of each of said first and second scissor blade pairs, wherein said aligned first and second bore holes are configured for receiving a securing element, wherein the load-relieving device (13) is not coupled to said central bearing (2) or said bearing receiving element (4), and wherein said aligned first and second bore holes into which said securing element is inserted are configured for allowing the first and second scissor blades of each of the first and second scissor blade pairs to be secured to one another such that the central bearing (2) becomes load-free and can be removed from the scissor-lift platform without disassembly of the entire said scissor-lift mechanism.

2. The scissor-lift mechanism as in claim 1, characterized in that the bearing receiving element (4) is housed in a fitting opening (5) in said at least one scissor blade (3) of each of the first and second scissor blade pairs, and wherein said fitting opening (5) is a bore hole in the at least one scissor blade (3) of each of the first and second scissor blade pairs.

3. The scissor-lift mechanism as in claim 1, characterized in that the bearing receiving element (4) has a connection region (6) formed as a flange.

4. The scissor-lift mechanism as in claim 3, characterized in that the connection region (6) of the bearing receiving element (4), is connected with the at least one scissor blade (3) of each of the first and second scissor blade pairs by means of detachable fastening elements.

5. The scissor-lift mechanism as in claim 1, characterized in that the bearing receiving element (4) has a bearing seat (7) for a bearing bushing (8) of a slide bearing.

6. The scissor-lift mechanism as in claim 5, characterized in that the slide bearing is a DU bearing.

7. The scissor-lift mechanism as in claim 6, characterized in that each of said first and second scissor blades (3) of each of said first and second scissor blade pairs have bearing receiving elements (4), wherein inside a central region of each of the bearing receiving elements (4) is housed a bearing bushing (8) of said DU bearing, together with a joint shaft (9).

8. The scissor-lift mechanism as in claim 1, characterized in that the bearing receiving element (4) has a bearing seat (10) for an outer ring of a pivoting bearing.

9. The scissor-lift mechanism as in claim 8, characterized in that at least one scissor blade (3) of each of said first and second scissor blade pairs has a bearing receiving element (4) that is modified for receiving a rotation-preventing bolt (12).

10. The scissor-lift mechanism as in claim 1, characterized in that the load-relieving device (13) is configured as one or more openings, wherein said one or more openings are bore holes configured for receiving a blocking element, and wherein said blocking element is a socket pin.

11. The scissor-lift mechanism of claim 1, characterized in that each of the first and second scissor blades (3) have means of connection (5), wherein said means of connection includes openings, in their regions that are to be connected to each other through said bearing receiving elements (4), wherein a plurality of various types of bearing receiving elements (4) is available and can be connected selectively with the first and second scissor blades (3), wherein the various types of bearing receiving elements (4) have different inner contours (7, 10) that fit a respective central bearing that is to be received in the bearing receiving element (4), and configured for installation and/or the replacement of central bearings (2) in scissor-lift mechanisms used in scissor-lift platforms.

* * * * *